US005649765A

United States Patent [19]

Stokes et al.

[11] Patent Number: 5,649,765

[45] Date of Patent: Jul. 22, 1997

[54] CONICAL MIXER APPARATUS WITH CONTAMINATION-PREVENTING ORBIT ARM ASSEMBLY

[75] Inventors: Michael J. Stokes, Cincinnati, Ohio; Michael J. Middendorf, Florence, Ky.

[73] Assignee: Littleford Day, Inc., Florence, Ky.

[21] Appl. No.: 643,971

[22] Filed: May 7, 1996

[51] Int. Cl.[6] ..... B01F 7/08

[52] U.S. Cl. ..... 366/287; 366/310; 366/331

[58] Field of Search ..... 366/281, 287, 366/282, 261, 276, 331, 288, 310

[56] References Cited

U.S. PATENT DOCUMENTS

| | | | |
|---|---|---|---|
| 3,775,863 | 12/1973 | Updergrove | 366/287 |
| 4,057,226 | 11/1977 | de Mos et al. . | |
| 4,311,397 | 1/1982 | Wright . | |
| 4,422,772 | 12/1983 | Baumgartner . | |
| 4,437,766 | 3/1984 | Joachim . | |
| 4,516,860 | 5/1985 | van der Laan et al. | 366/287 |
| 4,523,990 | 6/1985 | Duyckinck . | |
| 4,534,658 | 8/1985 | De Vries . | |
| 4,588,301 | 5/1986 | Bolz . | |
| 4,681,676 | 7/1987 | Heidinger et al. . | |
| 4,915,506 | 4/1990 | Antonius | 366/287 |
| 5,123,748 | 6/1992 | Schroer . | |
| 5,246,290 | 9/1993 | Bolz . | |

OTHER PUBLICATIONS

PhyMet, Inc. Manu. of Micropoly Lubricants, "Food Processing, Stop Bearing Failures and Reduce Delays".

PhyMet Inc. Sales Brochure, Springboro, Ohio, (No Date).

PhyMet, Inc. Manufacturers of Micropoly Lubricants, "More Than Just Bearing Lubricants".

PhyMet, Inc. Sales Brochure, Springboro, Ohio, (no date).

PhyMet., Inc. Manu. of Micropoly Lubs, "General Applications, Stop Bearing Failures and Reduce Delays".

PhyMet Inc. Sales Brochure, Springboro, Ohio (no date).

Joe Brown, "Intech Power Core, Nylon gears quiet vibrators" Power Transmission Design, Apr. 1992.

William Leventon, "Plastic–Metal Design Extends Gear's Life" Design News; May 3, 1993.

Intech Corporation, "lauramid–metal composites for gear systems engineering" Intech Power–Core Sales Brochure, Intech Corporation, Closter, NJ (No Date).

Charles Ross & Son Company, "Evolutionary Engineering, Vertical Blender"Ross Engineering Sales Brochure, Hauppauge, NY (No Date).

MikroPul Corporation, "Processing Equipment Based on the Nauta Mixing Principle" Nauta Mixing Division Sales Brochure (No Date).

Summix Terlet N.V., "The ultimate in solids mixing and dryers, summix screw mixers" Jayco, Incorporated Sales Brochure, Union New Jersey (No Date).

*Primary Examiner*—Robert W. Jenkins

*Attorney, Agent, or Firm*—Wood, Herron & Evans

[57] ABSTRACT

A conical mixer for mixing and processing materials comprises a mixing chamber, an orbit arm positioned within the chamber for rotating therearound and a mixing screw coupled to the end of the orbit arm for rotation simultaneous with the rotation of the orbit arm. A driver for rotating the screw is coupled to an orbit arm assembly which includes a first drive gear coupled to the driver and a first mixing screw shaft with a first driven gear which cooperates with the first drive gear to rotate the first mixing screw shaft. A second drive gear is positioned at the end of the first mixing screw shaft and cooperates with a second driven gear which is, in turn, coupled to a second mixing screw shaft. Each of the driven gears includes a plastic gear portion to engage the respective drive gear in a generally lubricant free engagement for reducing the amount lubricant exposed to the mixing space of the chamber. The first and second mixing screw shafts are supported by a plurality of bearings. The bearings include solid lubricant therein which is generally solidly contained in the bearing during operation of the orbit arm for preventing exposure to the inside of the mixer. Thereby contamination of the mixing space and maintenance of the mixer is reduced.

20 Claims, 4 Drawing Sheets

CONICAL MIXER APPARATUS WITH CONTAMINATION-PREVENTING ORBIT ARM ASSEMBLY

FIELD OF THE INVENTION

This invention relates generally to apparatus and method for industrial mixing and processing and particularly to conical industrial mixers having an orbit arm assembly which prevents leaks into the mixing chamber and thus prevents contamination of mixed material in the chamber.

BACKGROUND OF THE INVENTION

Processing of a large variety of consumer and industrial products, such as food, plastic, pharmaceutical and chemical products, usually involves one or more mixing steps for mixing component materials of the products. For accomplishing such mixing, large-capacity industrial mixers are utilized which are able to handle very large batches of material for more efficient and cost-effective mixing. One type of mixer design is referred to as a conical mixer because it utilizes a conically-shaped mixing chamber which is disposed generally vertically with respect to the ground surface. Oftentimes such conical mixers are suspended above the ground surface for more convenient discharge of the mixed material.

More specifically, conical mixers generally comprise a conically-shaped mixing chamber, an orbit arm which rotates or orbits around the inside of the chamber, and a mixing screw or auger, attached to the orbit arm, which also rotates on its own axis during the mixing process. The mixing screw is attached to the orbit arm and orbits around the chamber with the orbit arm. Simultaneously, the mixing screw rotates on a generally vertically disposed, but angled, axis. Thus, the conical mixer provides a dual mixing action, i.e., orbiting of the mixing screw around the chamber, and rotation of the mixing screw about its own axis. The mixing screw axis is usually angled to follow the angled side walls of the conically-shaped mixing chamber.

One motor driver rotates the orbit arm, while another motor driver rotates the mixing screw. The orbit arm is positioned inside of the mixing chamber and is operably mounted to orbit with the mixing screw about a centered axis. The orbit arm axis might also be offset to one side of the center of the mixing chamber as appropriate for the design of the conical mixer. The mixing screw is driven through an assembly in the orbit arm, and the main drive shaft of the mixing screw is generally centered and coaxially mounted with the main drive shaft of the orbit arm. However, since the mixing screw is positioned at the outer end of the arm, drive power must be transferred from the center cone axis to the off-center mixing screw. This is accomplished through a variety of different power transferring components including gears and shafts which are journaled in a plurality of bearing structures.

As will be appreciated, these moving gears and bearing structures require lubrication for proper operation and to prevent wear. Since the orbit arm assembly is positioned inside the mixing chamber, any contaminants from this assembly that migrate out, will be exposed to the material being mixed therein. More specifically, contaminants from the various internal moving components of the orbit arm and the lubrication oils and greases associated therewith are exposed to the mixed material through leakage from the assembly. Currently available conical mixers utilize a variety of different seals for preventing such leakage. Some conical mixers even use an elaborate fluid flow structure for directing lubricants away from openings or seams in the orbit arm assembly to prevent leakage.

While the predominant contamination associated with conical mixer orbit arms is leakage of lubricants from the orbit arm assembly, conventional conical mixers have not adequately addressed the problem. As will be appreciated, the constant orbiting of the arm and the rotation of the assembly components and the mixing screw will cause the various seals to wear and leak, whereby grease and lubricating liquid migrate through the assembly and into the conical mixing chamber thereby contaminating the mixed material. Furthermore, lubrication contaminant systems are also not entirely leak proof.

Such leakage and contamination within conical mixers is particularly a problem because of the materials mixed in such devices. Conical mixers provide low shear mixing and thus a variety of delicate products such as food and pharmaceuticals are mixed using conical mixers. Since food and pharmaceuticals are made for human consumption, even a small amount of contamination must be avoided. As mentioned, currently available conical mixers have not always adequately addressed such leakage and contamination problems.

Another problem with the leakage in the orbit arm assembly of a conical mixer is the requirement of continual maintenance of the orbit arm assembly and the mixing screw driving mechanisms. Leakage of lubricants from the orbit arm requires replacement of the lubricants and thus regularly scheduled maintenance. If such maintenance is not completed, the orbit arm assembly and the mixing screw drive components therein may prematurely wear or even seize up, thus requiring replacement of the components. Since the mixer must be inoperable during such maintenance and repair, processing delays are introduced and the efficiency and cost effectiveness of the conical mixer is thus reduced. Furthermore, the labor and material costs associated with such maintenance and repair increases the overall cost of using the conical mixer.

The problem of leakage is further exacerbated by the pressure requirements for certain mixing processes. For example, a vacuum is often required within the conical mixing chamber as a parameter for certain processes. The space within the orbit arm assembly is then maintained at a pressure higher than that within the conical mixing chamber. If the vacuum is not properly confined outside of the orbit arm assembly, the lubricants are effectively pulled out of the internal space of the orbit arm assembly to leak and contaminate the mixed material.

Accordingly, it is an objective of the present invention to address the drawbacks of the prior art conical mixers and to provide a conical mixer which reduces and eliminates contamination of the mixed material.

To that end, it is an objective of the present invention to reduce and prevent leakage of lubricants from the orbit arm assembly and from the mixing screw drive components within the mixing chamber.

It is another objective of the present invention to reduce the required maintenance for a conical mixer and to prevent failure of the orbit arm assembly and mixing screw drive components due to lubricant leakage.

It is another objective of the present invention to reduce delays associated with maintenance and repairs and thus increase the overall efficiency and cost effectiveness of a conical mixer and to thus reduce the maintenance and operational costs of utilizing a conical mixer.

SUMMARY OF THE INVENTION

The conical mixer of the present invention addresses various drawbacks associated with the prior art and reduces and prevents lubricant leakage and contamination associated therewith. The conical mixer of the invention further reduces maintenance and repairs associated with components failure and thereby reduces the costs and delays associated therewith.

To that end, the conical mixer of the invention includes a conically-shaped mixing chamber having an internal conically-shaped mixing space which contains materials to be mixed. An orbit arm is positioned within the chamber at the top of the chamber and is mounted to rotate generally coaxially within the chamber and around the internal mixing space of the chamber. A drive motor rotates the orbit arm. A mixing screw is coupled to the orbit arm for rotation around the mixing space and the mixing screw is operable for simultaneously rotating about an axis and mixing material in the space.

A driver motor is used to rotate the mixing screw simultaneously with the orbit arm. The orbit arm driver motor is positioned on top of the mixing chamber and the mixing screw driver motor is positioned proximate the orbit arm driver motor. The drive shafts for engaging the orbit arm and the mixing screw are coaxially mounted with each other and are generally centered at the top of the mixing chamber. In a preferred embodiment, the drive shaft for the orbit arm is hollow and the drive shaft for the screw extends therethrough and into the chamber to engage an orbit arm assembly. The respective drive shafts are generally vertically oriented.

In accordance with the principles of the present invention, the orbit arm assembly operably couples the mixing screw driver motor and drive shaft with the mixing screw. The orbit arm assembly includes a beveled drive gear which is connected to the mixing screw drive shaft. The drive gear is preferably fabricated of metal, such as stainless steel. An angled mixing screw transmission shaft, angled at approximately 107° with respect to the vertical, engages the vertical mixing screw drive shaft. The angled mixing screw transmission shaft includes a beveled driven gear at one end which cooperates with the beveled drive gear for rotating the angled mixing screw transmission shaft at 107° when the mixing screw drive shaft rotates. The driven gear includes a plastic gear portion which engages the drive gear in a generally lubricant free engagement thus eliminating the necessity of lubricant for the gears and thereby reducing the amount of lubricant exposed to the internal mixing space, such as by leakage through the orbit arm assembly, and reducing any contamination therefrom.

The angled mixing screw transmission shaft includes a beveled drive gear at the end opposite the driven gear. The drive gear is also preferably formed of stainless steel. Another mixing screw transmission shaft extends generally at 90° with respect to the angled mixing screw transmission shaft proximate the other beveled drive gear. The mixing screw is connected to the 90° mixing screw vertical transmission shaft and thereby is angled to extend generally parallel to the sloped side wall of the conically-shaped mixing chamber because of the 107° shaft.

The 90° mixing screw transmission shaft connected to the mixing screw includes another beveled driven gear which engages the drive gear of the 107° angled mixing screw transmission shaft. In accordance with the principles of the invention, the driven gear of the 90° shaft also includes a plastic gear portion for engaging the respective drive gear in a generally lubricant-free engagement to further reduce and eliminate contamination of the internal mixing space from the orbit arm assembly. Preferably, nylon 12 plastic is utilized for the gear portions of the driven gears which engage the stainless steel drive gears. The gears of the invention operate without the necessity of a free-flowing lubricant such as a lubricating oil or grease. In that way, leakage from the orbit arm assembly is reduced to thereby minimize and even eliminate contamination. Furthermore, maintenance, component failures, and delays associated with keeping the gears properly lubricated are also reduced.

The mixing screw drive shaft, the angled 107° mixing screw transmission shaft and the 90° mixing screw transmission shaft coupled between the driver motor and the mixing screw are each journaled within bearing structures for low friction rotation. The bearing structures are preferably ball bearings. In accordance with the principles of the invention, the bearing structures each include a solid lubricant which is generally solidly contained within the bearing structure during operation of the orbit arm and mixing screw. The solid lubricant remains generally within the bearing and thus does not move around inside the orbit arm assembly. Thus free-flowing lubricants from the bearings are not exposed to openings in the orbit arm for leakage into the internal mixing space. Therefore, the possibility for contamination of the mixed material from the orbit arm assembly leaking is further reduced. Additionally, maintenance and bearing failures from leakage of lubricants, and the delays associated therewith, are also reduced or eliminated. In one embodiment of the invention, the solid lubricant is a polymer lubricant which contains lubricating oil therein. The solid lubricant releases lubrication when the bearing is operating and then absorbs the lubricant when not operating to prevent leakage or contamination.

The present invention thus provides a conical mixer that does not require free-flowing lubricants in the orbit arm assembly and thus has a generally leak-free orbit arm assembly. The conical mixer of the invention effectively reduces contamination associated with orbit arm leakage. The conical mixer of the invention reduces the cost of operating the mixer by reducing maintenance and component failure associated with inadequate lubrication and also by reducing the delays associated with such maintenance and equipment failure. Accordingly, the present invention increases the cost efficiency of the mixer and the integrity of the mixed material.

These benefits and advantages of the invention, as well as other benefits of the invention, will become more readily apparent from the detailed description given hereinbelow.

BRIEF DESCRIPTION OF THE DRAWING

The accompanying drawings, which are incorporated in and constitute a part of this specification, illustrate embodiments of the invention, and together with a general description of the invention given above, and the detailed description of the embodiments given below, serve to explain the principles of the invention.

DETAILED DESCRIPTION OF SPECIFIC EMBODIMENTS

Figure 1:
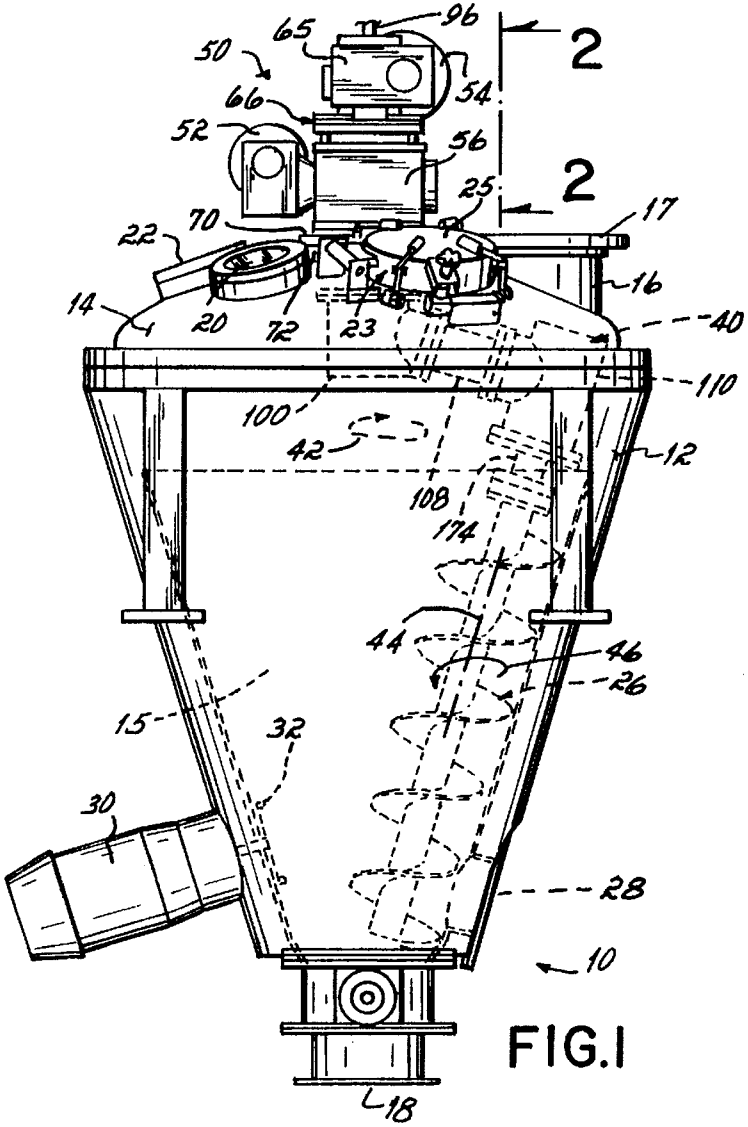
FIG. 1 is a perspective view of a conical mixer constructed in accordance with the principles of the invention.

FIG. 1 illustrates one embodiment of the conical mixer 10 of the present invention. Conical mixer 10 comprises a conically-shaped mixing chamber with a body 12 which is sealed by a cap or cover 14 to define an internal mixing space 15. Material to be mixed in space 15 is introduced through a charge port 16 which is sealed by an appropriate cap 17. After the material is mixed, it is discharged through discharge port 18 at the bottom of the conical mixer 10. Discharge port 18 is pneumatically controlled by a discharge valve. As illustrated in FIG. 1, the sloped side walls of conical mixer 10 provide a funnel action to the discharge port 18 for easy discharge.

Visual access to the mixing space 15 is provided through sight glass assemblies 20 and 22. In one embodiment, the sight glass assembly 22 comprises a light assembly (not shown) for viewing the inside of the mixing space 15 which will generally be dark. For mechanical access into the mixing chamber, a man way 23 is provided which is sealed with an appropriate cap 25. Cover 14 is preferably removably mounted to body 12, such as with a plurality of bolts around the periphery of the mixer. A lump breaker including a motor 30 and blade 32 is provided proximate the lower portion of the mixing space 15 to break up any compacted lumps within the mixed material for proper mixing. A bottom access opening 28 is also provided for access into space 15. The screw threads of the mixing screw are appropriately configured at the bottom end thereof to clear the blade as illustrated in FIG. 1.

Conical mixer 10 might be placed under vacuum and thus may include an appropriate vacuum port (not shown) for coupling the mixing space 15 to a vacuum system. Additionally, ports for connecting a pressure gauge (not shown) might also be included on the conical mixer 10. During a particular mixing process the mixed material may need to be heated or cooled accordingly. To that end, conical mixer 10 might also include a jacket (not shown) for heating and cooling the body 12 and thus heating and cooling the mixing space 15.

Conical mixer 10 further comprises a mixing screw 26 which is operably coupled to an orbit arm 40. During operation of conical mixer 10, the orbit arm 40 is orbited around the inside of the mixer as indicated by reference arrow 42. Simultaneously, mixing screw 26 is rotated about its axis 44 indicated by reference numeral 46. Therefore, conical mixer 10 provides a dual action in which the mixing screw 26 is orbited and then simultaneously rotates while it orbits. Mixing screw 26 rotates in the direction indicated by arrow 46 to draw the mixed material upwardly from the bottom of mixing space 15 toward the top of the mixing space 15.

Figure 2:
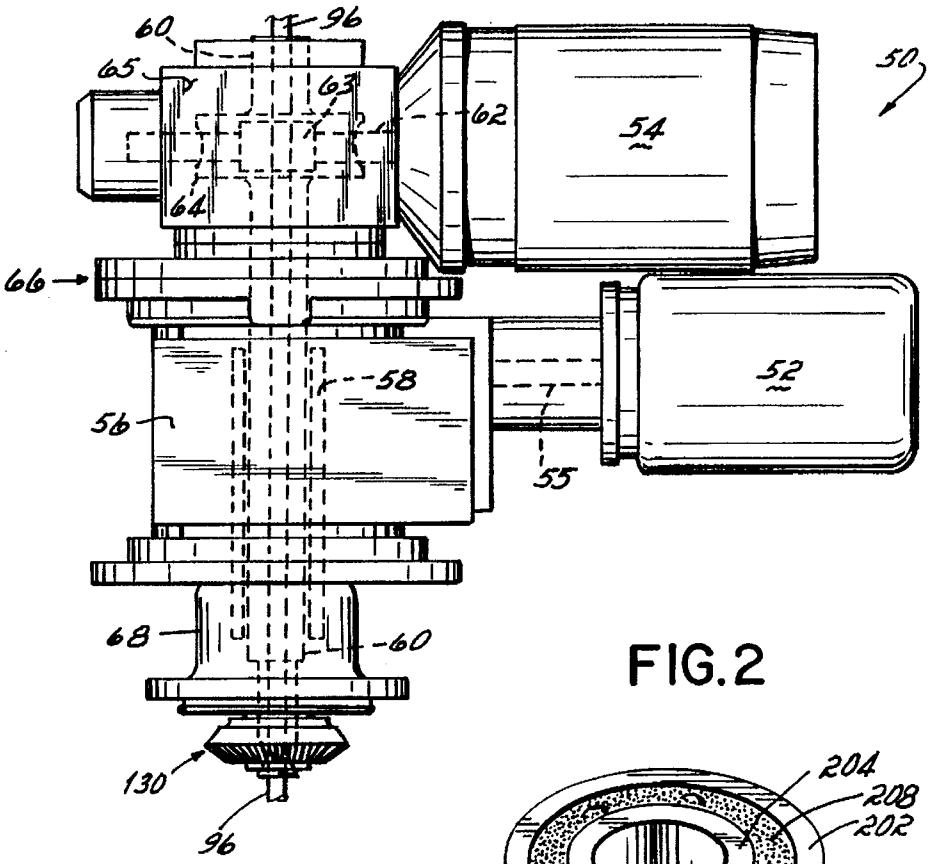
FIG. 2 is a perspective view, in partial section, along line 2—2 of FIG. 1 showing a drive assembly for rotating the orbit arm and mixing screw of the conical mixer of FIG. 1.

Turning now to FIG. 2, the orbit arm 40 is coupled to a drive mechanism 50 comprising an orbit arm driver motor or driver 52 and a mixing screw driver motor or driver 54. Orbit arm driver motor 52 is coupled via a drive shaft 55 to a worm gear (not shown) within gear box 56. The worm gear is, in turn, coupled to a worm wheel (not shown) which is, in turn, coupled to the orbit arm drive shaft 58. Orbit arm drive shaft 58 is a hollow shaft which surrounds the mixing screw drive shaft 60 discussed further hereinbelow. The orbit arm drive motor 52 may be a 1 HP, 1800 rpm AC motor, although other types of motors might be used. Through the appropriate worm gearing in gear box 56, which preferably utilizes a double reduced worm gear, the rotational rate of the orbit arm drive shaft 58 is reduced to approximately 5 rpm or lower. In that way, orbit arm 40 rotates somewhat slowly and provides low shear to the mixed material. Therefore, during a mixing process, orbit arm driver motor 52 rotates orbit arm 40 to thereby orbit the mixing screw 26 around the mixing space 15.

For simultaneously rotating mixing screw 26, the mixing screw driver motor 54 is coupled via drive shaft 62 to a worm gear 63. Worm gear 63 is then coupled to a worm wheel 64 connected to shaft 60. The worm gear 63 and worm wheel 64 are contained within a gear box 65. Gear box 65 is mounted on top of gear box 56 through an appropriate mounting plate assembly 66. Mixing screw driver motor 54 may be a 5 HP, 1800 rpm AC motor, although other motors might also be used. Driver motor 54 rotates the mixing screw drive shaft 60 inside of the orbit arm drive shaft 58 as illustrated in FIG. 2. In that way, simultaneous orbiting and rotation of the mixing screw is achieved as discussed further hereinbelow.

Figure 3:
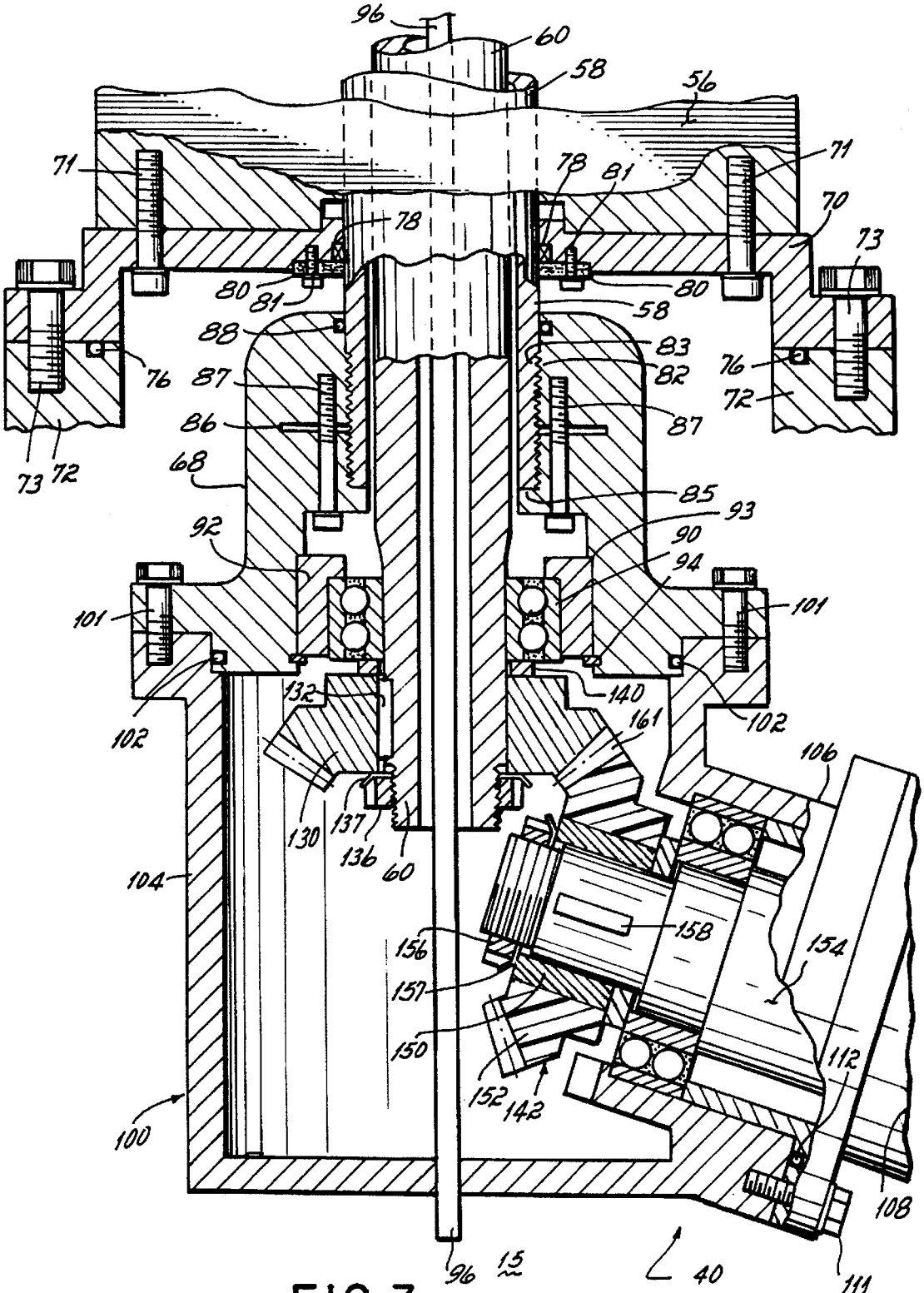
FIG. 3 is a fragmentary cross-sectional view of a portion of the conical mixer and the orbit arm assembly.

Drive shaft 58 is coupled to the orbit arm 40 through a bell housing 68 which rotates with shaft 58 as illustrated in FIGS. 2 and 3. Turning now to FIG. 3, shaft 58 extends through a mounting pad 70 which is mounted to the orbit arm gear box 56 with appropriate bolts 71. Mounting pad 70 is, in turn, mounted to a dome mounting pad 72 which is welded or appropriately fastened to cover 14 (see FIG. 1). Mounting pad 70 and dome mounting pad 72 are coupled together with appropriate bolts 73. To confine any vacuum drawn within the mixing space 15, a pressure seal 76, such as a rubber O-ring, is positioned at the interface between the respective mounting pads 70, 72.

The mixing space 15 is further vacuumed sealed where mounting pad 70 surrounds shaft. 58 by a Teflon lip seal 78 which is held in position by a seal retaining ring 80 connected to mounting pad 70 by bolts 81. In that way, the gear boxes and the outside atmosphere are isolated from the mixing space 15 such that a vacuum or pressurized environment in the mixer may be maintained.

Bell housing 68 includes internal threads 82 which cooperate with external threads 84 on the outside diameter of shaft 58. Bell housing 68 is screwed to the end of shaft 58 such that the bottom of shaft 58 abuts with an appropriate shoulder 85 of the bell housing 68. To lock the respective threads 82, 84 together for a secure coupling, bell housing 68 includes a horizontally disposed annular gap 86 which surrounds the threads 82, 84. A plurality of bolts 87 positioned around the bell housing 68 are tightened to effectively shorten the gap 86 and thus lock the threads 82, 84 together. To further maintain the vacuum within mixing space 15 and to prevent leakage into the internal space of the orbit arm 40, a vacuum seal 88, such as a rubber O-ring, is positioned around shaft 58 proximate the top of the bell housing 68. Rotation of the bell housing 68 rotates the orbit arm assembly as described further hereinbelow.

To insure smooth rotation of bell housing 68 around the mixing screw drive shaft 60, a bearing structure 90, preferably a ball bearing structure, is situated between bell housing 68 and the shaft 60. Bearing 90 is maintained in place by a bearing sleeve 92 which is held within bell housing 68 by a shoulder 93 and a retaining ring 94. Bearing 90 provides smooth rotation of the orbit arm assembly 40 about the mixing screw drive shaft 60. In accordance with the principles of the present invention, bearing 60 is filled with a generally solid polymer lubricant as discussed further hereinbelow.

As illustrated in FIGS. 1, 2 and 3, the conical mixer 10 of the invention includes a liquid introduction tube 96 for introducing liquid into the mixing space 15 to become part of the mixed material which is acted upon by the conical mixer 10. The liquid introduction tube 96 extends through the mixing screw drive shaft 60, which is also hollow.

Figure 4:
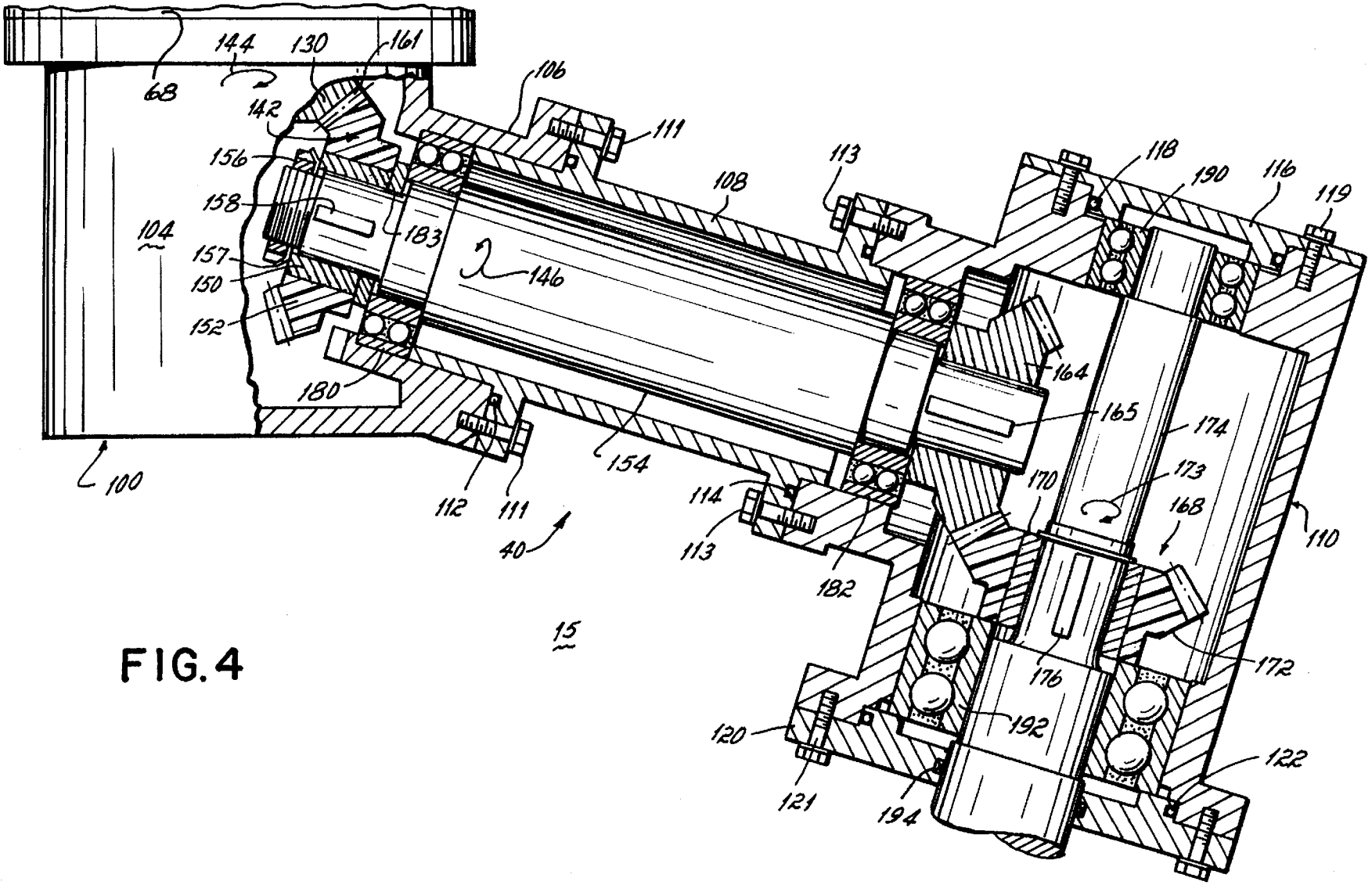
FIG. 4 is another cross-sectional view of the orbit arm assembly of the invention.

Referring to FIGS. 3 and 4, the orbit arm 40 of the invention comprises an assembly of housings, shafts, gears, bearings and other components which cooperate for forming the orbit arm and transferring power from the mixing screw driver motor 54 to the mixing screw 26. The orbit arm assembly includes a 107° housing 100 which is coupled to the bell housing 68 with appropriate bolts 101. To confine the vacuum or pressure within the horizontal mixer, a vacuum or pressure seal 102, such as a rubber O-ring, is positioned at the interface between the housing 100 and the bell housing 68. Housing 100 includes a generally vertical portion 104 and an angled portion 106 which is angled from the vertical approximately 107°, thereby designating the housing as a 107° housing. As disclosed hereinbelow, the angle of housing 100 is oriented to provide a 90° engagement with mixing screw 26 while still maintaining mixing screw 26 general parallel with the sloped side walls of the conical mixer body 12.

Referring to FIG. 4, the orbit arm assembly further includes an arm housing 108 and a 90° gear housing 110. Arm housing 108 is coupled to the angled portion 106 of housing 100 using appropriate bolts 111. Similarly, the other end of the arm housing 108 is coupled to the gear housing 110 with bolts 113. To confine the vacuum and prevent the draw of vacuum in the internal space of the orbit arm assembly, appropriate vacuum seals 112 and 114, such as rubber O-rings, are positioned at the interfaces between the arm housing 108 and the housing 100 and gear housing 110, respectively. An upper end of the gear housing 110 is sealed by a bearing retainer cap 116, and the interface between the retainer cap and the bearing housing 110 is sealed by a vacuum or pressure seal 118, such as a rubber O-ring, for confining the vacuum or pressure within the mixing space. Bearing retainer cap 116 is coupled to the gear housing 110 by appropriate bolts 119. The lower end of gear housing 110 is sealed by a lower bearing retainer cap 120 which is coupled gear housing 110 by appropriate bolts 121. A vacuum seal 122, such as a rubber O-ring, is positioned at the interface between the bearing retainer cap 120 and the gear housing 110 to further contain the vacuum as discussed herein above. Preferably, seals 112, 114, 118, and 122 are VITON rubber seals.

The orbit arm assembly also includes a plurality of gears, shafts and bearings which are utilized to drive the mixing screw as the orbit arm 40 rotates. Returning to FIG. 3, a drive gear 130 is coupled to the lower end of the mixing screw drive shaft 60. Gear 130 is preferably formed of 304 stainless steel and includes an appropriate key structure 132 for coupling the gear to the end of shaft 60. Therefore, upon rotation of shaft 60, the gear 130 will rotate.

Gear 130 is further held onto shaft 60 by a nut 136, and corresponding lock washer 137, which screws onto a threaded portion 138 of shaft 60. The nut 136 forces gear 130 upwardly, and a shim 140 bears against bearing S0 to hold the bearing within the bearing sleeve 92. Nut 136 further acts to hold the bell housing 68 in position through the interaction of the various components between nut 136 and the bell housing.

Referring now to FIG. 4, the stainless steel drive gear 130 cooperates with or engages a driven gear 142. In accordance with the principles of the present invention, the driven gear 142 is fabricated of a plastic material. Driven gear 142 cooperates with drive gear 130 such that when drive gear 130 rotates in a clockwise direction as designated by arrow 144, the driven gear 142 will be rotated in a counterclockwise direction as designated by arrow 146.

Figure 6:
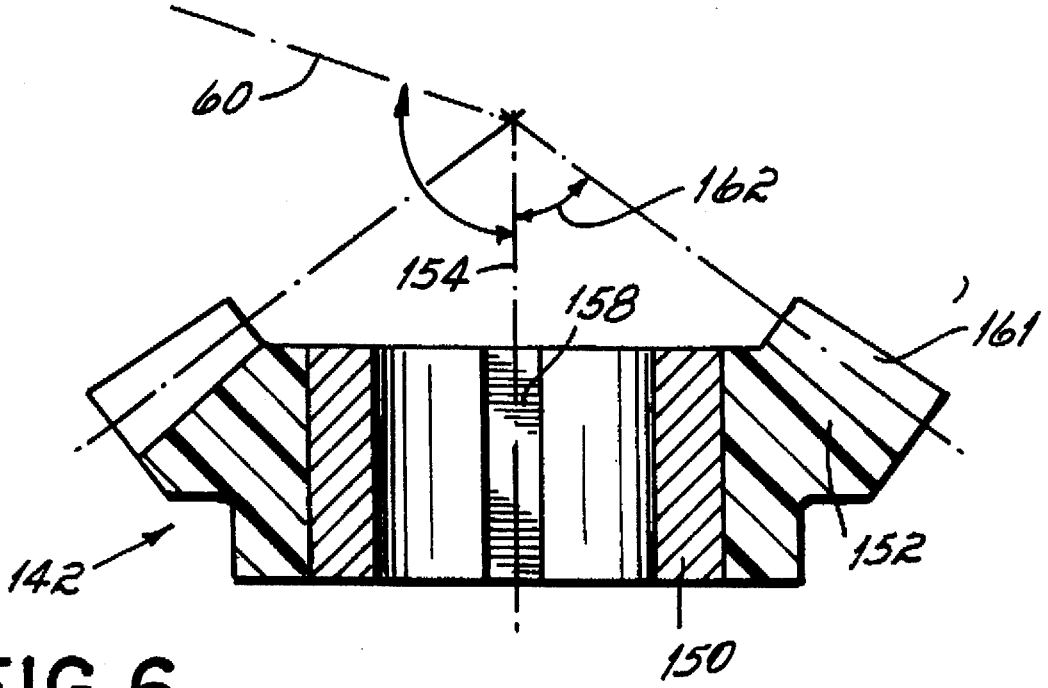
FIG. 6 is a cross-sectional view of a gear constructed in accordance with the principles of the invention and used in the orbit arm assembly of the invention; and, FIG. 7 is a cross-sectional view of another gear constructed in accordance with the principles of the invention and used in the orbit arm assembly of the invention.

Referring to FIGS. 4 and 6, the driven gear 142 of the invention includes a stainless steel hub 150 made of 303 stainless steel surrounded by a gear portion 152 made of a plastic such as nylon plastic. Preferably Nylon 12 plastic is utilized. The hub 150 is secured to the mixing screw shaft or drive shaft 154 by an appropriate nut 156 and lock washer 157 which are threaded onto a threaded end of shaft 154. An appropriate key structure 158 insures that the gear 142 will properly rotate with shaft 154 (see FIG. 4). The plastic gear portion 152 of driven gear 142 is machined such that it will engage the drive gear 130 and provide a 107° disposition of shaft 154 with respect to a vertical orientation. As illustrated in FIG. 6, one embodiment of a driven gear 142 in accordance with the invention is machined as a beveled gear which has teeth 161 which are beveled at an angle with respect to the vertical of approximately 48° as illustrated by angle 162. Driven gear preferably includes about 20 teeth as will be adequate for the operation of the present invention. Further dimensions and properties of one embodiment of the plastic driven gear 142 are illustrated according to Table 1 below. It will be readily understood that other sizes and shapes of gears may also be utilized in accordance with the principles of the invention to handle different torques and mechanical requirements.

TABLE 1

| SPIRAL BEVEL GEAR (DRIVEN) | |
|---|---|
| Number of Teeth | 20 |
| Diametral Pitch | 4 |
| Face Width | 1.06 |
| Pressure Angle | 20° |
| Shaft Angle | 107° |
| Working Depth | 0.500 |
| Whole Depth | 0.550 |
| Addendum | 0.250 |
| Dedendum | 0.300 |
| Pitch Diameter | 5.000 |
| Outside Diameter | 5.297 |
| Pitch Angle | 53.5° |
| Face Angle of Blank | 115° of 20" ± 15' |
| Back Cone Angle | 73° |
| Mounting Distance | 2.798 |
| Backlash with Mate | 0.016–0.018 |
| Cone Distance | 3.110 |
| Spiral Angle | 35° |
| Direction of Rotation | C.C.W. |

To achieve a shaft angle of 107°, the stainless steel drive gear 130 is also beveled at an angle of approximately 59° from the vertical. One particular plastic material which is suitable for the plastic gear portion 152 of driven gear 142 is a Nylon-12 plastic sold under the trademark POWER-CORE™ by Intech Corporation of Closter, New Jersey.

In accordance with the principles of the invention, the driven gear 142 meshes with the stainless steel drive gear 130 without the requirement of lubrication such as a packing grease or free-flowing lubricating oil. Accordingly, no lubrication is necessary within the 107° housing for proper engagement and operation of the gears. As a result, contamination is reduced and maintenance of the conical mixer 10 is reduced thus reducing the costs of operating the conical mixer in the invention. Furthermore, conical mixer 10 does not have to be shut down for scheduled or unscheduled maintenance further reducing delays and increasing the efficiency of the mixer. Still further, since lubricants are not necessary within the 100 housing for proper operation of gears 130 and 142, component failure from lack of lubrication is no longer a problem, and thus repair costs and delays are also reduced by the present invention.

Drive shaft 154 is driven in a counter clockwise direction as indicated by arrow 146. A stainless steel beveled drive gear 164 is secured to the end of drive shaft 154 and also rotates in a counter clockwise direction. Drive clear 164 is coupled to the end of shaft 154 by an appropriate key structure 165. Drive gear 164 engages a composite driven gear 168. Driven gear 168 is similar to driven gear 142 and has a gear portion formed of a plastic material such as nylon plastic which surrounds a stainless steel hub 170.

Figure 7:
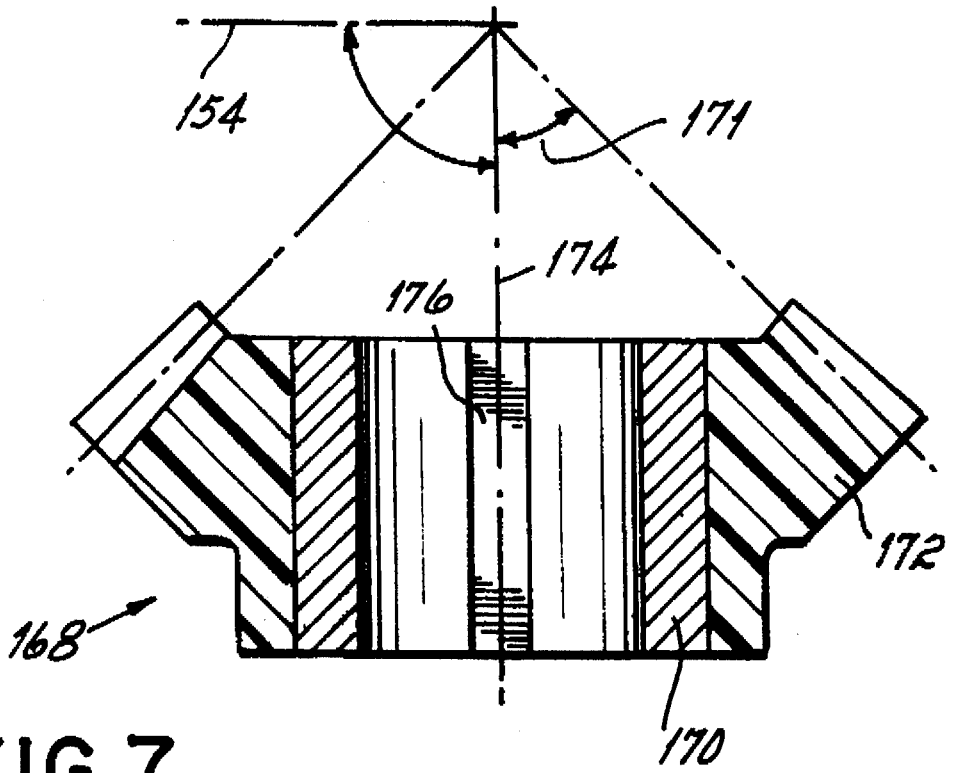

Turning now to FIGS. 4 and 7, driven gear 168 includes a 303 stainless steel hub port on 170 surrounded by a composite gear portion 172. The plastic gear portion 172 is fabricated to form a beveled gear which cooperates and intermeshes with drive gear 164. As drive gear 164 rotates in counter clockwise direction 146, driven gear 168 is rotated in a clockwise direction as indicated by arrow 173. The beveled gear portion 172 is fabricated to an angle of approximately 42° with respect to the vertical as illustrated by angle 171. Drive shaft 154 engages the mixing screw shaft 174 at a 90° angle within gear housing 110. Mixing screw shaft 174 is appropriately coupled to the elongated mixing screw 26 (see FIG. 1). Clockwise rotation of mixing screw shaft 174 thus provides clockwise rotation of the mixing screw 26. Driven gear 168 is secured to mixing screw shaft 174 by an appropriate key structure 176. The 42° bevel of gear 168 cooperates with an approximately 48° bevel of drive gear 164 to provide the 90° engagement between drive shaft 154 and mixing screw shaft 174. The plastic driven gear 168 interacts with stainless steel drive gear 164 again without the need for an external lubricant such as grease or lubricating oil. Table 2 gives additional particulars regarding one embodiment of driven gear 168 of the invention. Other embodiments and sizes may also be used as necessary.

TABLE 2

| SPIRAL BEVEL GEAR (DRIVEN) | |
|---|---|
| Number of Teeth | 20 |
| Diametral Pitch | 4 |
| Face Width | 1.06 |
| Pressure Angle | 20° |
| Shaft Angle | 90° |
| Working Depth (Middle) | 0.2438 |
| Whole Depth (Middle) | 0.2743 |
| Addendum (Mid Tooth) | 0.1219 |
| Dedendum (Mid Tooth) | 0.1524 |
| Pitch Diameter | 5.000 |
| Outside Diameter | 5.261 |
| Pitch Angle | 45° |
| Face Angle of Blank | 95.981° ± 15' |
| Back Cone Angle | 90° |
| Mounting Distance | 3.792 |
| Backlash with Mate | 0.016–0.018 |
| Cone Distance | 3.5355 |
| Spiral Angle | 35° |
| Direction of Rotation | C.W. |

Therefore, lubricants within the orbit arm housing are further eliminated in accordance with the principles of the present invention to reduce leakage and contamination of the mixed material. Furthermore, maintenance and component failure are also reduced as discussed above and the overall efficiency and cost effectiveness of the conical mixer 10 of the present invention is increased.

To further prevent contamination due to lubricant leakage from the orbit arm assembly, the present invention utilizes bearing structures having a solid lubricant which does not flow freely or drip within the orbit arm assembly. Therefore, free-flowing or free moving lubricant, such as grease or lubricating oil, is eliminated from the orbit arm housing in accordance with the principles of the present invention and the operation of the orbiting arm and the associated mixing screw is not compromised.

One end of drive shaft 154 is journaled within a bearing structure 180 which is preferably a ball bearing structure. The other end of the shaft 154 is journaled in a similar bearing structure 182. In that way, shaft 154 smoothly rotates within the orbit arm assembly for driving shaft 174 and rotating mixing screw 26. Bearing 180 is contained between housing 108 and housing 100. A spacer 183 is positioned between the bearing 180 and the driven gear 142 for proper seating and securement of the gears 130 and 142. Bearing 182 is secured between gear 164 and a shoulder of shaft 154. A shim (not shown) might also be utilized, such as between the bearing 182 and gear 164, for proper spacing of the components.

For rotation of shaft 174, ore end of the shaft is journaled in a bearing structure 190, such as a ball bearing structure. Another bearing structure 192, such as a ball bearing structure, is positioned opposite bearing structure 190 proximate driven gear 168. Bearing structure 190 is secured between cap 116 and a shoulder of shaft 174 while bearing structure 192 is secured between gear 168 and cap 120.

A portion of shaft 174 extends through an opening in cap 120. Accordingly, a dynamic seal 194, such as a lip seal made of Teflon, is positioned around shaft 174 and an appropriate opening formed in the cap 120. The seal 194 confines the vacuum and pressure in the chamber.

Figure 5:
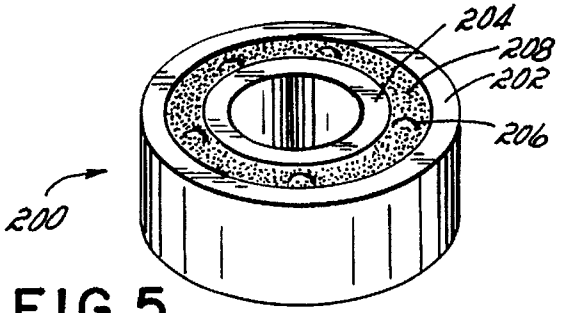
FIG. 5 is a perspective view of a bearing structure constructed in accordance with the principles of the present invention.

In accordance with the present invention, each of the bearing structures 90, 180, 182, 190 and 192 includes a solid lubricant which eliminates loose grease or free-flowing lubricating oil. Referring to FIG. 5, a ball bearing structure is illustrated and is similar to the bearing structures utilized in the disclosed embodiment of the present invention is shown. Bearing structure 200 is a double row ball bearing and comprises an outer ring 202 which cooperates with an inner ring 204 to contain the various rows of ball bearings 206 therebetween. Rings 202 and 204 form appropriate bearing races (not shown) for guiding the ball bearings.

In accordance with the principles of the invention, conventional loose grease is not packed within the bearings. Rather, the bearing structures are filled with a solid lubricant 208 which does not generally move around within the bearing and thus does not move around within the orbit arm assembly. The solid lubricant utilized in the present invention does not require further sealing and thus the ball bearings are generally exposed as opposed to "sealed for life" bearing in which all of the lubricant must be mechanically sealed within the bearing structure.

The solid lubricant 208 preferably fills the bearing cavities between the rings 202, 204 and around the ball bearings 206. In a preferred embodiment, the solid lubricant 208 is a polymer lubricant which will release lubrication when the bearing is operating and rotating and then will contain the lubricant, such as by reabsorbing any excess lubricant. In that way, no free-flowing lubricant or loose grease will leak from the bearing structure. The inventive bearing structures as illustrated in FIG. 5 further prevent and eliminate lubricant leakage and contamination of mixed material within the conical mixer 10. Still further, the bearings 200 do not have to be constantly packed with grease.

The combination of plastic gears within the orbit arm assembly of the invention and the bearings containing solid lubricants provide an orbit arm assembly 40 which does not have any loose or free-flowing lubricants therein. That is, there is no grease or lubricating oil to seep out of the rotating orbit arm assembly and drip into the mixing space 15. Therefore, contamination is reduced or eliminated. Maintenance on the conical mixer to pack bearings with grease or to provide lubricating oil within the orbit arm assembly is also eliminated. Furthermore, component failure due to running dry because of excessive leakage is also eliminated. In addition, contamination of the mixed material, and the subsequent loss of material due to contamination is reduced thus yielding a more cost effective mixing process.

The conical mixer of the present invention is more efficient and cost effective to operate cue to the reduction in maintenance and repairs. Furthermore, contamination-sensitive products such as pharmaceuticals and food may be mixed within the conical mixer without concern for contamination from lubricant leakage. One type of solid lubricant suitable for the present invention is a polymer lubricant available under the trademark Micropoly™ from PhyMet, Inc. of Springboro, Ohio. The Micropoly™ lubricant is an oily porous polymer which releases lubrication while operating and then partially reabsorbs the excess lubricant while leaving a thin film of protective oil within the bearing.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A conical mixer for mixing and processing materials comprising:

a mixing chamber having an internal mixing space for containing materials to be mixed;

an orbit arm positioned within the chamber and operable for rotating around the internal mixing space of the chamber;

a mixing screw coupled to the orbit arm for rotation around the mixing space with the orbit arm, the mixing screw operable for simultaneously rotating about an axis and mixing material in the space;

a driver for rotating the screw;

an orbit arm assembly operably coupling the driver and the mixing screw, the orbit arm assembly including a first mixing screw shaft operably coupled to the mixing screw and having a first driven gear, the assembly further including a first drive gear operably coupled to the driver, the first drive gear cooperating with the first driven gear to rotate the first mixing screw shaft and the mixing screw;

at least one of said first drive and first driven gears including a plastic gear portion for engaging the other of said gears in a generally lubricant free engagement for reducing the amount of lubricant exposed to the internal mixing space;

a bearing structure rotatably supporting the mixing screw shaft in the orbit arm assembly, the bearing structure including a solid lubricant which is generally solidly contained in the bearing structure during operation of the orbit arm for preventing exposure to an opening in the orbit arm and exposure to the internal mixing space;

whereby contamination of the mixing space and maintenance of the mixer is reduced.

2. The conical mixer of claim 1 wherein the orbit arm assembly further comprises a second mixing screw shaft having a second driven gear and being operably coupled to the mixing screw, the first mixing screw shaft having a second drive gear which cooperates with the second driver gear on the second shaft to couple the first and second mixing screw shafts together for rotating the mixing screw.

3. The conical mixer of claim 2 wherein at least one of said second drive and second driven gears includes a plastic gear portion for engaging the other of said gears in a generally lubricant free engagement for further reducing the amount of lubricant exposed to the internal mixing space.

4. The conical mixer of claim 1 wherein the plastic is a nylon plastic.

5. The conical mixer of claim 1 wherein the solid lubricant includes a polymer lubricant.

6. The conical mixer of claim 5 wherein the polymer lubricant is saturated with oil.

7. The conical mixer of claim 1 further comprising a shaft housing for containing the mixing screw shaft, the shaft housing including a portion angled from the vertical between 90 and 120 degrees for positioning the mixing screw proximate a side of the mixing chamber.

8. A conical mixer for mixing and processing materials comprising:

a mixing chamber having an internal mixing space for containing materials to be mixed;

an orbit arm positioned within the chamber and operable for rotating around the internal mixing space of the chamber;

a mixing screw coupled to the orbit arm for rotation around the mixing space with the orbit arm, the mixing screw operable for simultaneously rotating about an axis and mixing material in the space;

a driver for rotating the screw;

an orbit arm assembly operably coupling the driver and the mixing screw, the orbit arm assembly including:

a first drive gear coupled to the driver to be rotated by the driver;

first mixing screw shaft having a first driven gear at one end thereof which cooperates with the first drive gear for rotating the first mixing screw shaft;

a second drive gear at the other end of the first mixing screw shaft which rotates with the first mixing screw shaft;

a second mixing screw shaft coupled to the mixing screw for rotating the mixing screw, the second mixing screw shaft having a second driven gear which cooperates with the second drive gear for rotating the second mixing screw shaft and the mixing screw;

at least one of said first and second driven gears including a plastic gear portion for engaging the respective drive gear in a generally lubricant free engagement for reducing the amount of lubricant exposed to the internal mixing space;

at least one bearing structure rotatably supporting each of the mixing screw shafts in the orbit arm assembly, the bearing structures including a solid lubricant which is generally solidly contained in the bearing structure during operation of the orbit arm for preventing exposure to an opening in the orbit arm and exposure to the internal mixing space;

whereby contamination of the mixing space and maintenance of the mixer is reduced.

9. The conical mixer of claim 8 wherein the plastic is a nylon plastic.

10. The conical mixer of claim 8 wherein the driver is coupled to the first drive gear with a generally vertical drive shaft, the first mixing screw shaft extending at an angle with respect to said drive shaft of between 90 and 120 degrees.

11. The conical mixer of claim 8 wherein the second mixing screw shaft extends at an angle to the first mixing screw shaft of between approximately 60 and 90 degrees.

12. The conical mixer of claim 8 wherein the solid lubricant includes a polymer lubricant.

13. The conical mixer of claim 8 wherein the polymer lubricant is saturated with oil.

14. The conical mixer of claim 8 wherein at least one of the bearing structures is a ball bearing structure.

15. A conical mixer for mixing and processing materials comprising:

a mixing chamber having an internal mixing space for containing materials to be mixed;

an orbit arm positioned within the chamber and operable for rotating around the internal mixing space of the chamber;

a mixing screw coupled to the orbit arm for rotation around the mixing space with the orbit arm, the mixing screw operable for simultaneously rotating about an axis and mixing material in the space;

a driver for rotating the screw;

an orbit arm assembly operably coupling the driver and the mixing screw, the orbit arm assembly including a mixing screw shaft operably coupled to the mixing screw and having a driven gear, the assembly further including a drive gear operably coupled to the driver, the drive gear cooperating with the driven gear to rotate the first mixing screw shaft and the mixing screw;

at least one of said drive and driven gears including a plastic gear portion for engaging the other of said gears in a generally lubricant free engagement for reducing the amount of lubricant exposed to the internal mixing space;

a bearing structure rotatably supporting the mixing screw shaft in the orbit arm assembly, the bearing structure including a solid lubricant which is generally solidly contained in the bearing structure during operation of the orbit arm for preventing exposure to an opening in the orbit arm and exposure to the internal mixing space;

whereby contamination of the mixing space and maintenance of the mixer is reduced.

16. The conical mixer of claim 15 wherein the orbit arm assembly further comprises another mixing screw shaft supporting said first drive gear and including another driven gear, the assembly including another drive gear coupled to the driver and cooperating with the another driven gear of said another screw shaft for rotating the mixing screw.

17. The conical mixer of claim 16 wherein at least one of said another drive gear and said another driven gears includes a plastic gear portion for engaging the other of said gears in a generally lubricant free engagement for further reducing the amount of lubricant exposed to the internal mixing space.

18. The conical mixer of claim 16 further comprising another bearing structure for supporting said another mixing screw shaft in the orbit arm assembly, the another bearing structure including a solid lubricant which is generally solidly contained in the bearing structure during operation of the orbit arm for preventing exposure to an opening in the orbit arm and exposure to the internal mixing space.

19. A conical mixer for mixing and processing materials comprising:

a mixing chamber having an internal mixing space for containing materials to be mixed;

an orbit arm positioned within the chamber and operable for rotating around the internal mixing space of the chamber;

a mixing screw coupled to the orbit arm for rotation around the mixing space with the orbit arm, the mixing screw operable for simultaneously rotating about an axis and mixing material in the space;

a driver for rotating the screw;

an orbit arm assembly operably coupling the driver and the mixing screw, the orbit arm assembly including a driven gear operably coupled to the screw and a drive gear operably coupled to the driver, the drive gear cooperating with the driven gear to rotate the mixing screw;

at least one of said drive and driven gears including a plastic gear portion for engaging the other of said gears for reducing the amount of lubricant exposed to the internal mixing space;

the orbit arm assembly further including a bearing structure rotatably coupled between said mixing screw and driver, the bearing structure including a solid lubricant which is generally solidly contained in the bearing structure during operation of the orbit arm for preventing exposure to an opening in the orbit arm and exposure to the internal mixing space;

whereby contamination of the mixing space and maintenance of the mixer is reduced.

20. A conical mixer for mixing and processing materials comprising:

a mixing chamber having an internal mixing space for containing materials to be mixed;

a mixing screw positioned in the chamber and operable for rotating about an axis and mixing material in the space;

a driver for rotating the screw;

an arm assembly operably coupling the driver and the mixing screw, the arm assembly including a driven gear operably coupled to the screw and a drive gear operably coupled to the driver, the drive gear cooperating with the driven gear to rotate the mixing screw;

at least one of said drive and driven gears including a plastic gear portion for engaging the other of said gears for reducing the amount of lubricant exposed to the internal mixing space;

the arm assembly further including a bearing structure rotatably coupled between said mixing screw and driver, the bearing structure including a solid lubricant which is generally solidly contained in the bearing structure during operation of the orbit arm for preventing exposure to an opening in the orbit arm and exposure to the internal mixing space;

whereby contamination of the mixing space and maintenance of the mixer is reduced.

* * * * *

UNITED STATES PATENT AND TRADEMARK OFFICE

CERTIFICATE OF CORRECTION

PATENT NO. : 5,649,765

DATED : July 22, 1997

INVENTOR(S) : Michael J. Stokes and Michael J. Middendorf

It is certified that error appears in the above-identified patent and that said Letters Patent is hereby corrected as shown below:

On the title page item [57],

In the Abstract, line 6, delete "screw" and insert --mixing screw--.

Column 7, line 66, delete "S0" and insert --90--.

column 9, line 21, delete "hub port on" and insert --hub portion--.

Column 10, line 28, delete "ore end" and insert --one end--.

Column 11, line 21, delete "cue" and insert --due--.

Column 12, line 15, delete "driver gear" and insert --driven gear--.

Column 13, line 20, delete "of claim 8" and insert --of claim 12--.

Signed and Sealed this

Twenty-eighth Day of April, 1998

Bruce Lehman

*Attest:*

BRUCE LEHMAN

*Attesting Officer*

*Commissioner of Patents and Trademarks*